US008011770B2

(12) United States Patent
Hattori

(10) Patent No.: US 8,011,770 B2
(45) Date of Patent: Sep. 6, 2011

(54) LIQUID CONTAINERS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 800 days.

(21) Appl. No.: 11/957,264

(22) Filed: Dec. 14, 2007

(65) Prior Publication Data

US 2008/0231675 A1 Sep. 25, 2008

(30) Foreign Application Priority Data

Mar. 20, 2007 (JP) ..... 2007-071899

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 6,585,358 B2 7/2003 Usui et al.
6,802,602 B2 * 10/2004 Sakai et al. ..... 347/86
7,011,397 B2 * 3/2006 Miyazawa et al. ..... 347/86
7,090,341 B1 * 8/2006 Miyazawa ..... 347/85
7,434,923 B2 * 10/2008 Miyazawa et al. ..... 347/86

FOREIGN PATENT DOCUMENTS

JP 2001270130 A 10/2001
JP 2001341324 A 12/2001

OTHER PUBLICATIONS

The State Intellectual Property Office of the People'S Republic of China, Notification of the Second Office Action for Chinese Patent Application No. 200810086871.4 (counterpart to above-captioned patent application), issued Mar. 31, 2011.

* cited by examiner

*Primary Examiner* — Anh T. N. Vo
(74) *Attorney, Agent, or Firm* — Baker Botts L.L.P.

(57) ABSTRACT

A liquid container includes a liquid chamber, a liquid supply chamber, a liquid introduction portion, and a particular liquid path. The liquid chamber is at least partially defined by at least one first wall, the liquid supply chamber is defined by at least one second wall having a first opening and a second opening formed therethrough, and the liquid introduction portion is defined by at least one third wall having a third opening formed therethrough. The particular liquid path extends from the third opening to the second opening, and the liquid introduction portion is configured to introduce fluid from an exterior of the liquid container to the liquid supply chamber via the particular liquid path. The particular liquid path is positioned externally from the liquid chamber.

13 Claims, 9 Drawing Sheets

LIQUID CONTAINERS

CROSS-REFERENCE TO RELATED APPLICATION

The present invention claims priority from Japanese Patent Application No. JP-2007-071899, which was filed on Mar. 20, 2007, the disclosure of which is incorporated herein by reference in its entirety.

BACKGROUND OF THE INVENTION

1. Field of the Invention

The present invention relates generally to liquid containers comprising a liquid path through which liquid is introduced into the liquid container.

2. Description of Related Art

A known liquid container, such as an ink cartridge, is configured to be removably mounted to a known recording apparatus, such as an ink-jet recording apparatus. The known liquid container has a liquid chamber configured to store liquid therein, and a liquid supply opening configured to supply liquid from the interior of the liquid chamber to the exterior of the liquid container. When the liquid container is mounted to the recording apparatus, liquid stored in the liquid chamber is supplied to a recording head of the known recording apparatus through the liquid supply opening.

The liquid container has a valve configured to selectively open and close the liquid supply opening. The valve is stored in a cylindrical storage chamber which is partitioned from the liquid chamber by a portioning wall. The storage chamber is in fluid communication with the liquid chamber via an opening formed through the partitioning wall. When the liquid chamber is filled with liquid during the manufacture of the liquid container, the interior of the storage chamber may not be filled with the liquid, and air may remain in the interior of the storage chamber adjacent to the liquid supply opening. When liquid is supplied from the liquid chamber to the recording head, the air in the interior of the storage chamber may enter the recording head, which may cause defective liquid discharge from the recording head. Therefore, there is a need to remove air from a space adjacent to the liquid supply opening.

In order to remove air from the space adjacent to the liquid supply opening, in a known method, the liquid chamber is filled with liquid after the interior of the liquid chamber is depressurized. With this method, the amount of air remaining in the space adjacent to the liquid supply opening may be reduced. Nevertheless, even in this method, it is difficult to remove all or substantially all of the air in the space adjacent to the liquid supply opening.

SUMMARY OF THE INVENTION

Therefore, a need has arisen for liquid containers, such as ink cartridges, which overcome these and other shortcomings of the related art. A technical advantage of the present invention is that when the liquid container is filled with liquid, air is removed from the space adjacent to the liquid supply opening.

According to an embodiment of the present invention, a liquid container comprises a liquid chamber configured to store liquid therein, a liquid supply chamber, a liquid introduction portion, and a particular liquid path. The liquid chamber is at least partially defined by at least one first wall, the liquid supply chamber is defined by at least one second wall having a first opening and a second opening formed therethrough, and the liquid introduction portion is defined by at least one third wall having a third opening formed therethrough. The liquid chamber is further configured to be in fluid communication with the liquid supply chamber via the first opening. The particular liquid path extends from the third opening to the second opening, and the liquid introduction portion is configured to introduce fluid from an exterior of the liquid container to the liquid supply chamber via the particular liquid path. The particular liquid path is positioned externally from the liquid chamber.

According to another embodiment of the present invention, a liquid container comprises a liquid chamber configured to store liquid therein, a liquid supply chamber, a liquid introduction portion, and a particular liquid path. The liquid chamber is defined by at least one first wall, and the liquid supply chamber is defined by at least one second wall having a first opening, a second opening, and a third opening formed therethrough. The liquid chamber is further configured to be in fluid communication with the liquid supply chamber via the first opening, and the liquid supply chamber is configured to be in fluid communication with an exterior of the liquid container via the third opening. The particular liquid path extends from the liquid introduction portion to the second opening, and the second opening is positioned between the first opening and the third opening. The liquid introduction portion is configured to introduce fluid from the exterior of the fluid container to the liquid supply chamber via the particular fluid path, and the particular fluid path is positioned externally from the liquid chamber.

According to yet another embodiment of the present invention, a liquid container comprises a liquid chamber configured to store liquid therein, a liquid supply chamber, a liquid introduction portion, and a particular liquid path. The liquid chamber is defined by at least one first wall, and the liquid supply chamber is defined by at least one second wall having a first opening and a second opening formed therethrough. The liquid chamber is further configured to be in fluid communication with the liquid supply chamber via the first opening. The particular liquid path extends from the liquid introduction portion to the second opening, and the liquid introduction portion is configured to introduce fluid from an exterior of the fluid container to the liquid supply chamber via the particular fluid path. The particular fluid path is positioned externally from the liquid chamber, and at least a portion of the liquid chamber separates the liquid introduction portion from the first opening.

According to still another embodiment of the present invention, a liquid container comprises a liquid chamber configured to store liquid therein, a liquid supply chamber, a liquid introduction portion, a valve member, and particular liquid path. The liquid chamber is defined by at least one first wall, and the liquid supply chamber is defined by at least one second wall having a first opening and a second opening formed therethrough. The valve member is configured to regulate liquid flow between the liquid chamber and the liquid supply chamber via the first opening. The particular liquid path extends from the liquid introduction portion to the second opening, and the liquid introduction portion is configured to introduce fluid from an exterior of the fluid container to the liquid supply chamber via the particular fluid path. The particular fluid path is positioned externally from the liquid chamber.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

FIG. 9(*b*) depicts a state in which the ink supply chamber is entirely filled with ink; and FIG. 9(*c*) depicts a state in which the ink supply chamber and an ink chamber are filled with ink.

DETAILED DESCRIPTION OF EMBODIMENTS

Embodiments of the present invention and their features and technical advantages may be understood by referring to FIGS. 1-9(*c*), like numerals being used for like corresponding portions in the various drawings.

Figure 1B:
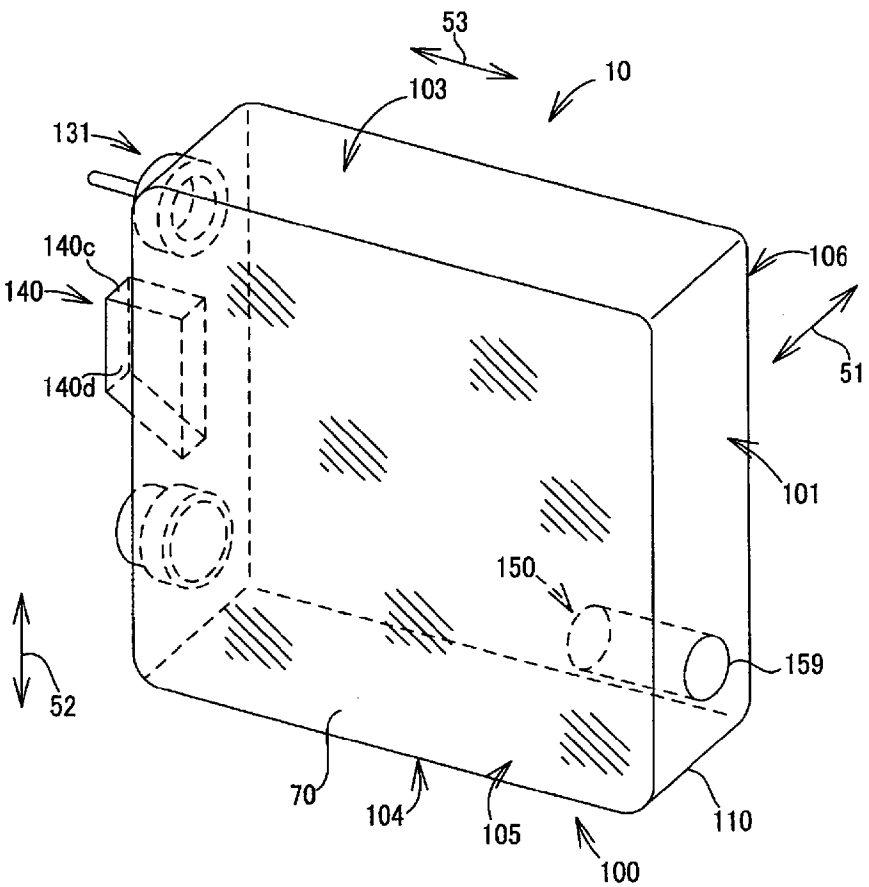
FIGS. 1(*a*) and 1(*b*) are a front-face, perspective view and a rear-face perspective view of an ink cartridge, respectively, according to an embodiment of the present invention.
Figure 1A:
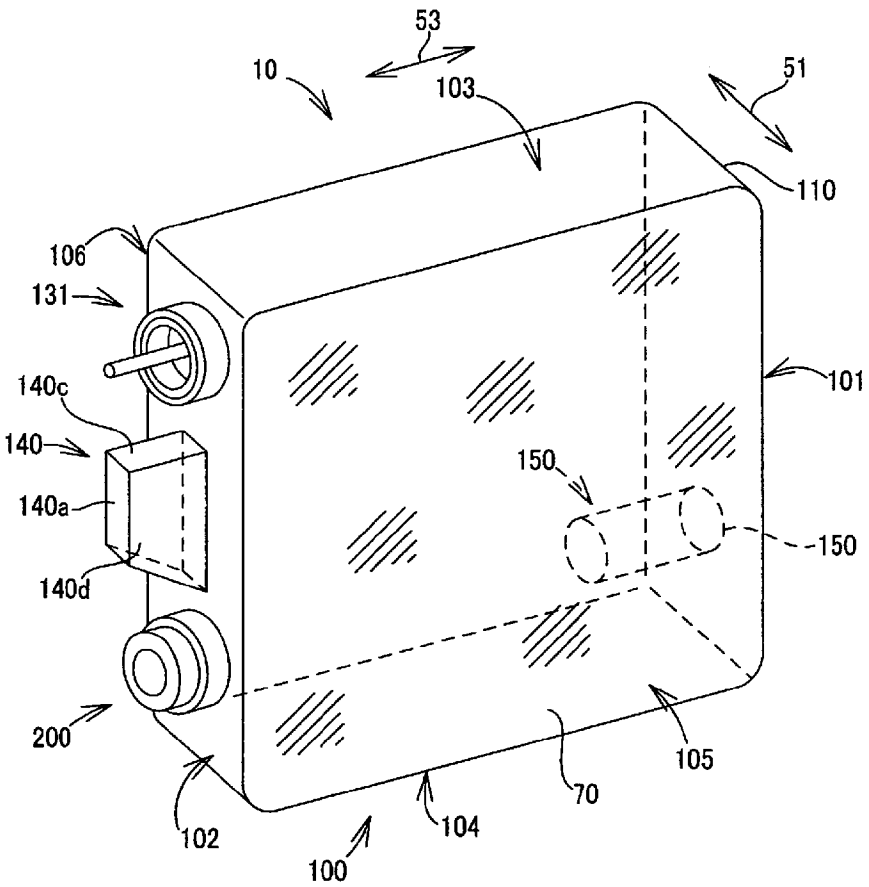

Referring to FIG. 1, a liquid container, e.g., an ink cartridge 10, according to an embodiment of the present invention, may have a substantially flat, hexahedron shape. A width of the ink cartridge, as indicated by an arrow 51, may be relatively short, and each of a height of the ink cartridge 10, as indicated by an arrow 52, and a depth of the ink cartridge 10, as indicated by an arrow 53, may be greater than the width of the ink cartridge 10. The ink cartridge 10 may comprise a front face 102, a rear face 101 opposite the front face 102, top face 103, a bottom face 104 opposite the top face 103, a left side face 105, and a right side face 106 opposite the left side face 105. Each of the top face 103 and the bottom face 104 is connected to the front face 102 and the rear face 101, and each of the left side face 105 and the right side face 106 is connected to the front face 102, the rear face 101, the top face 103, and the bottom face 104. The front face 102, the rear face 101, the top face 103, the bottom face 104, the left side face 105, and the right side face 106 may be parallel to the opposing face and may be perpendicular to the other faces. Each of the area of the left side face 105 and the area of the right side face 106 may be greater than each of the area of the front face 102, the area of the rear face 101, the area of the top face 103, and the area of the bottom face 104. The ink cartridge 10 may be configured to be installed in a printer (not shown) from the front face 102 in an upright state shown in FIG. 1.

Figure 2:
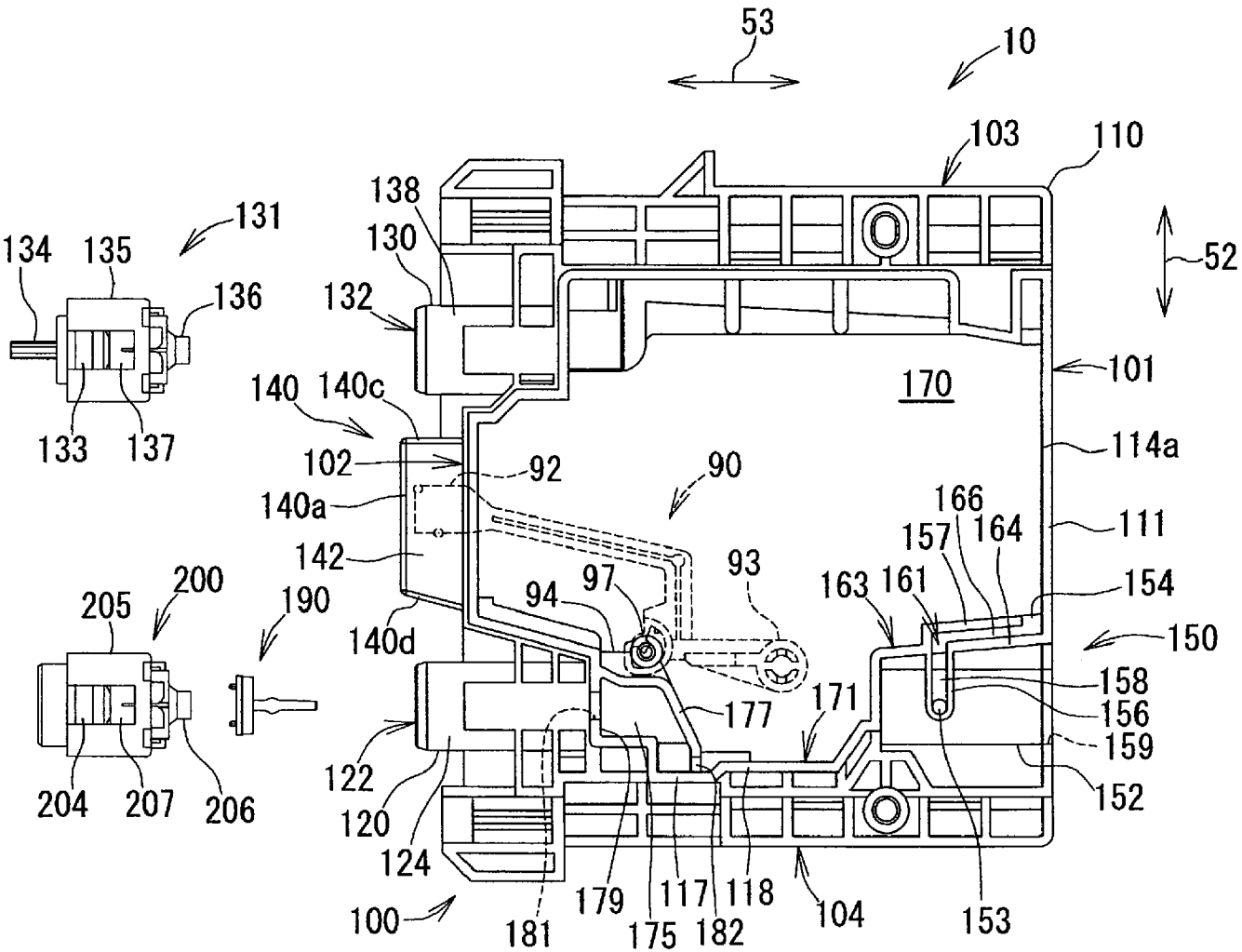
FIG. 2 is an exploded, left side view of the ink cartridge of FIGS. 1(*a*) and 1(*b*).
Figure 3:
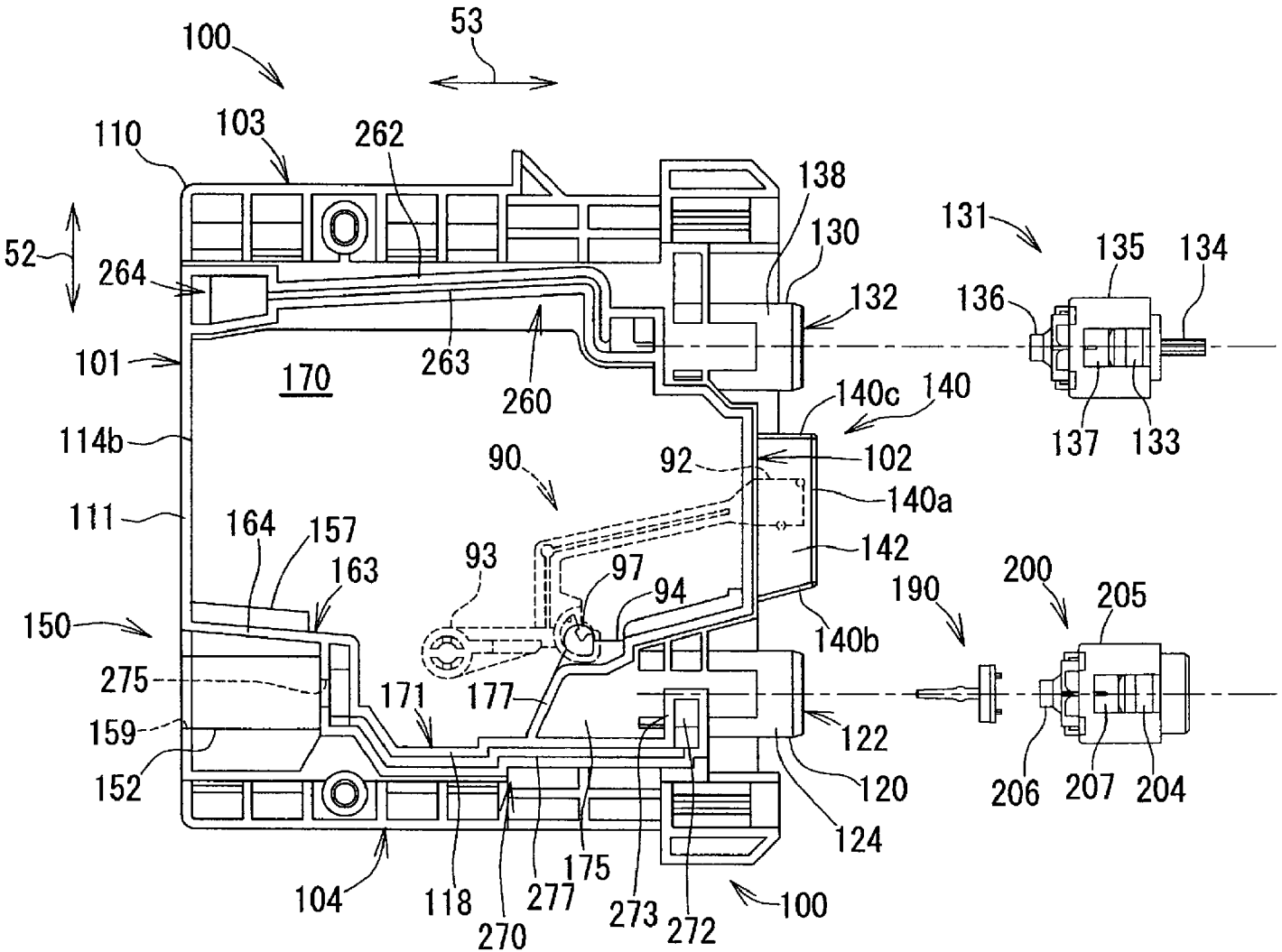
FIG. 3 is an exploded, right side view of the ink cartridge of FIGS. 1(*a*) and 1(*b*).

Referring to FIGS. 1 through 3, the ink cartridge 10 may comprise a main body 100, a movable member 90, an air intake valve mechanism 131, and the ink supply valve mechanism 200. Each of the main body 100, the movable member 90, the air intake valve mechanism 131, and the ink supply valve mechanism 200 may comprise at least one resin material, e.g., nylon, polyethylene, polypropylene or the like. Because the ink cartridge 10 does not comprise a metal, the ink cartridge 10 may be burned after the ink cartridge 10 is disposed. The ink cartridge 10 may further comprise a case (not shown) covering the main body 100 or a protector (not shown) covering the ink supply valve mechanism 200.

The main body 100 may comprise a frame 110. Moreover, each of the left side face 105 and the right side face 106 may comprise a film 70 (shown in FIG. 1, but not shown in FIGS. 2-5(*b*)), e.g., a translucent film.

The frame 110 may comprise a translucent material, such as transparent or semi-transparent resin material e.g. polyacetal, nylon, polyethylene, or polypropylene, or combinations thereof, to allow light to pass therethrough, and the frame 110 may be manufactured using injection-molding. The frame 110 may comprise an ink introduction portion 150, a translucent portion 140, an ink supply chamber 120, and an air intake chamber 130.

The frame 110 may comprises an outer peripheral wall 111 extending from the left side face 105 to the right side face 106. The outer peripheral wall 111 may have a substantially square or rectangular perimeter extending along the front face 102, the top face 103, the rear face 101, and the bottom face 104 and forms a space inside. An opening 114*a* may be formed on the left side face 105 of the frame 110, and an opening 114*b* may be formed on the right side face 106.

The films 70 may be connected to e.g., welded, to the left side face 105 and the right side face 106 of the peripheral wall 111, respectively, via ultrasonic welding, and the opening 114*a* and the opening 114*b* may be covered by the respective films 70, such that the outer peripheral wall 111 and the films 70 defines the ink chamber 170. Alternatively, the films may be omitted, and the frame 110 may have a parallelepiped, container shape, such that the frame 110 defines the ink chamber 170 therein.

The ink introduction portion 150 may be positioned in the rear face 101 of the frame 110 below a middle portion of the rear face 101. The ink introduction portion 150 may be configured to introduce ink into the interior of the ink chamber 170 when the ink cartridge 10 is manufactured.

The translucent portion 140 may be positioned at the front face 102 of the frame 110 and may extend from the ink chamber 170. An amount of ink stored in the ink chamber 170 may be optically or visually detected via the translucent portion 140. The translucent portion 140 is integral with the frame 110, and comprises the same material as the frame 110, e.g., the translucent portion 140 comprises a translucent resin material to allow light to pass therethrough.

The translucent portion 140 projects outward from a center portion of the front face 102 of the frame 110 in a direction away from the ink chamber 170. The translucent portion 140 may comprise five rectangular walls and may have a substantially a hollow box shape. For example, the translucent portion 140 may comprise a front wall 140*a*, a pair of side walls 140*b*, top wall 140*c*, and bottom wall 140*d*. The front wall 140*a* may extend parallel to the front face 102 and may be separated from the front face 102 by a predetermined distance. The pair of side walls 140*b* may be connected to the front face 102 and the front wall 140*a*, the top wall 140*c* may be connected to top ends of the front wall 140*a* and the side walls 140*b*, and the bottom wall 140*d* may be connected to bottom ends of the front wall 140*a* and the side walls 140*b*. Moreover, the width of the front wall 140*a* may be less than the width of the front face 102.

When the ink cartridge 10 is mounted to the printer, the translucent portion 140 may be sandwiched between a light-emitting element (not shown) and a light-receiving element (not shown) of an optical sensor (not shown), e.g. photo interrupter, mounted to the printer. Light emitted by the light-emitting element may pass through the side walls 140*b* and may be received by the light-receiving element.

The translucent portion 140 may have an inner space 142 formed therein, which may be defined by the front wall 140*a*, the side walls 140*b*, the top wall 140*c* and the bottom wall 140*d*. The inner space 142 may be configured to be in fluid communication with the interior of the ink chamber 170, e.g., there is no wall positioned between the inner space 142 and the ink chamber 170. A signal blocking portion 92 of the movable member 90 may be configured to selectively enter and move out of the inner space 142 based on an amount of ink within the ink chamber 170.

The movable member 90 may be used in detecting whether the ink chamber 170 has a sufficient amount of ink therein. The movable member 90 may comprise the signal blocking portion 92 at one end thereof, and a float portion 93 at the other end thereof. The movable member 90 may be pivotably supported at a rib 94 extending upright from the widthwise center of the outer peripheral wall 111. The specific gravity of the float portion 93 may be less than the specific gravity of ink stored in the ink chamber 170. The float portion 93 may have a hollow formed therein, and may float on ink, such that the float portion 93 moves upward and downward based on the amount of ink within the ink chamber 170, and the movable member 90 pivots based on the movement of the float portion 93. The rib 94 may be positioned at the outer peripheral wall 111 adjacent to the corner of the front face 102 and the bottom face 104. The rib 94 may comprise a supporting portion 97 configured to pivotably support the movable member 90.

Referring to FIGS. 2 and 3, when the ink chamber 170 stores a sufficient amount of ink therein, the movable member 90 may be positioned, such that the signal blocking portion 92 is positioned in the inner space 142. For example, the signal blocking portion 92 may contact the bottom wall 140*d* of the translucent portion 140 and remain within the inner space 142. Moreover, when the ink chamber 170 does not store a sufficient amount of ink therein, the float portion 93 may move downward, and the signal blocking portion 92 may move out of the inner space 142. Accordingly, whether the ink chamber 170 is storing a sufficient amount of ink therein may be detected by monitoring whether the signal blocking portion 92 is positioned within the inner space 142. For example, an optical sensor, such as a photo interrupter, may be used to monitor whether the signal blocking portion 92 is positioned within the inner space 142.

Referring to FIGS. 2 and 3, a circular opening 132 may be formed in an upper portion of the front face 102 of the frame 110 above the translucent portion 140. A cylindrical air intake chamber 130 may be positioned in the interior of the frame 110 extending from the opening 132 towards the ink chamber 170. The air intake chamber 130 may be positioned separately from the ink chamber 170, and may be defined by a cylindrical wall 138. An end of the air intake chamber 130 opposite the circular opening 132 may be in fluid communication with the ink chamber 170 via a bypass 260. The air intake chamber 130 may be configured to store the air intake valve mechanism 131 therein.

The air intake valve mechanism 131 may be configured to selectively open and close the opening 132, and the air intake valve mechanism 131 may comprise a valve body 137, a spring 136, a sealing member 133, a rod 134 and a cap 135. The valve body 137 may be urged by the spring 136 in a direction to close the opening 132. The rod 134 may project from the front face 102. When the rod 134 may be pushed towards the air intake chamber 130 against the urging force of the spring 136, the opening 132 is opened.

Referring to FIG. 3, the bypass 260 may extend from the cylindrical wall 138 of the air intake chamber 130 towards the rear face 101 along the right side face 106. The bypass 260 may be positioned separately from the ink chamber 170, and may be connected at one end to the air intake chamber 130. The other end of the bypass 260 may have an opening 264 which may be formed in the vicinity of the corner of the rear face 101 and the top face 103, and the opening 264 may be opened to the ink chamber 170. The bypass 260 may be configured to discharge air in the ink chamber 170 from the opening 132 to the exterior of the ink cartridge 10, and to draw air from the exterior of the ink cartridge 10 into the interior of the ink chamber 170 via the opening 132.

The outer peripheral wall 111 may comprises an upper wall 262 defining an upper portion of the ink chamber 170. The upper wall 262 may have a groove 263 formed therein. The groove 263 may be formed in an outer end of the upper wall 262 on the right side face 106 side. The film 70 may be welded to the upper wall 262 to cover the groove 263, and the bypass 260 may be defined by the groove 263, the film 70, and the upper wall 262.

Referring to FIGS. 2 and 3, a circular opening 122 may be formed in a lower portion of the front face 102 of the frame 110 below the translucent portion 140. The ink supply chamber 120 may be positioned in the interior of the frame 110 extending from the opening 122 towards the ink chamber 170 along the depth direction, as indicated by the arrow 53. The liquid chamber 170 may comprise a communication chamber 175, and the communication chamber 175 may be positioned adjacent to the ink supply chamber 120 at an end of the ink supply chamber 120 opposite from the opening 122.

Figure 4:
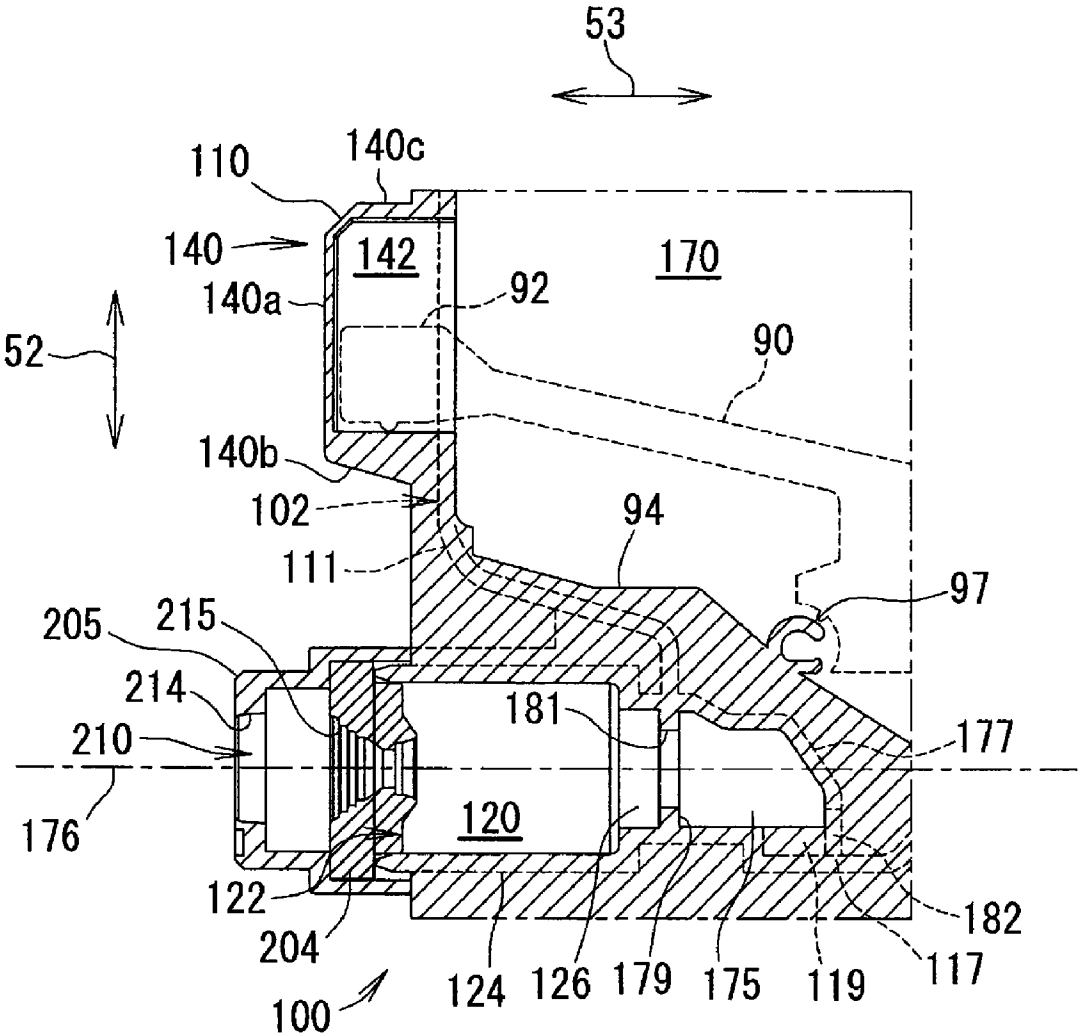
FIG. 4 is a partial, cross-sectional view of an ink supply chamber of the ink cartridge of FIGS. 1(*a*) and 1(*b*).

Referring to FIG. 4, the ink supply chamber 120 may be positioned outside the outer peripheral wall 111. On the other hand, the communication chamber 175 may be positioned inside the outer peripheral wall 111. The outer peripheral wall 111 may comprise a partitioning wall 179 which partitions the communication chamber 175 and the ink supply chamber 120. The partitioning wall 179 may have a communication opening 181 formed therethrough. The communication chamber 175 and the ink supply chamber 120 may be in fluid communication via the communication opening 181.

The ink supply chamber 120 may be defined by a cylindrical wall 124, and the end of the ink supply chamber 120 opposite the opening 122 may be defined by the partitioning wall 179. The ink supply chamber 120 may comprise a cylindrical valve storage section 126 positioned adjacent to the partitioning wall 179 and connected to the communication opening 181. The ink supply chamber 120 may be configured to store the ink supply valve mechanism 200, and the valve storage section 126 may be configured to store a check valve 190.

Figure 5A:
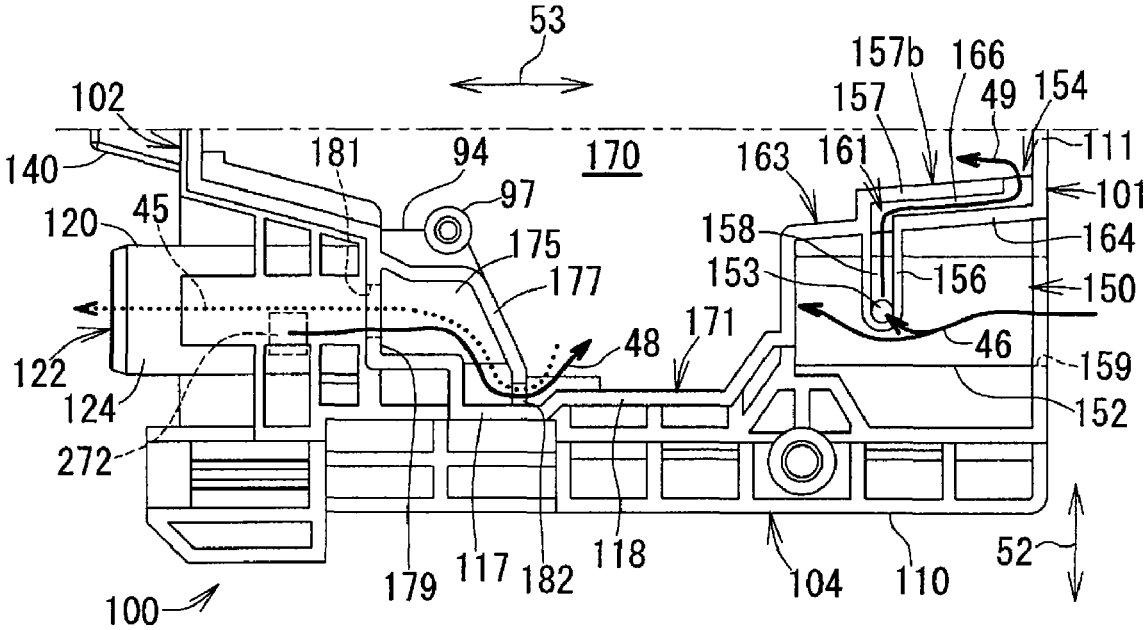
FIGS. 5(*a*) and 5(*b*) are enlarged, left side and right side views of a lower portion of the ink cartridge of FIGS. 1(*a*) and 1(*b*), respectively.
Figure 5B:
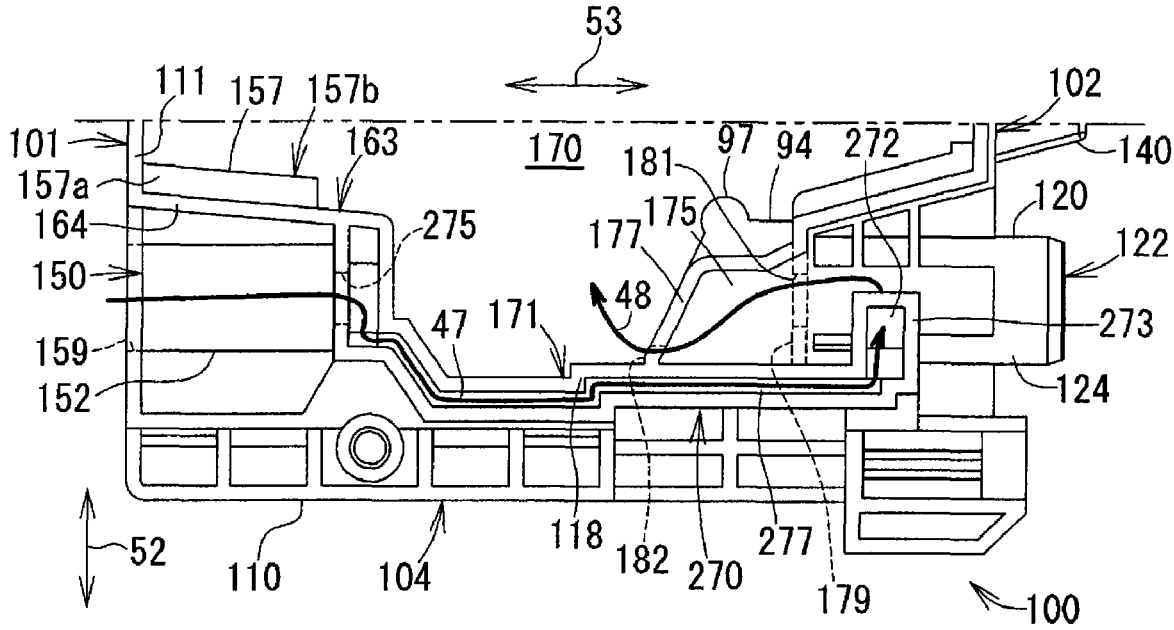

Referring to FIG. 5(*b*), the wall 124 may have an opening 272 formed therethrough. The opening 272 may be positioned between the circular opening 122 and the communication opening 181. The ink supply chamber 120 may be in fluid communication with a particular liquid path 270 via the opening 272. The opening 272 may penetrate through the wall 124 from the ink supply chamber 120 towards the right side face 106 of the ink cartridge 10 in the direction perpendicular to the paper plane of FIG. 5(*b*).

A partitioning wall 273 may extend from the wall 124 towards the right side face 106 to surround the opening 272. The partitioning wall 273 may partition the opening 272 from the ink chamber 170, and may partially define a portion of the particular liquid path 270. The partitioning wall 273 may open at the bottom thereof, and may surround the left and right sides and the upper side of the opening 272. The film 70 may be welded to the partitioning wall 273 on the right side face 106 side.

The peripheral wall 111 may comprise a bottom wall 118, and the bottom wall 118 may define a lower portion of the ink chamber 170. The films 70 may be welded to the outer ends of a partitioning wall 177, the outer ends of the partitioning wall 179, and the outer ends of the bottom wall 118 on the sides of the side faces 105 and 106, and the partitioning wall 177, the partitioning wall 179, the bottom wall 118, and the films 70 may define the communication chamber 175 therein. The capacity of the communication chamber 175 may be less than the capacity of the ink supply chamber 120. The communication chamber 175 may become narrower when approaching from the ink supply chamber 120 to the ink chamber 170.

The cylindrical ink supply chamber 120 may have an axial center line 176 in the depth direction, as indicated by the arrow 53. The communication opening 181 may be aligned with the axial center line 176 of the ink supply chamber 120.

The partitioning wall 177 may surround the communication opening 181. More specifically, the partitioning wall 177 may have a semi-arcuate shape spanning between the partitioning wall 179 and the bottom wall 118. The partitioning wall 177 may have a communication opening 182 formed therethrough at a position connected to the bottom wall 118. The communication chamber 175 may be in fluid communication with a main portion of the ink chamber 170 via the communication opening 182. The communication opening 182 may be offset from an axial center liner 176 of the ink supply chamber 120.

The communication opening 182 may be defined by a cutout formed through an outer end of the partitioning wall 177 on the left side face 105 side and the film 70 welded to the outer end. The communication opening 182 may have a rectangular shape. The communication opening 182 may have a triangle shape, a semi-circular shape, a substantially circular shape, or a substantially oval shape. The area of the communication opening 182 may be less than each of the area of an ink supply opening 210 and the area of the communication opening 181. Consequently, when ink flows out from the ink supply opening 210, the flow rate of the ink at the communication opening 182 may be greater than the flow rate the ink at the ink supply opening 210 and the communication opening 181. Therefore, all or substantially all of the air bubbles may not remain at a position in the vicinity of the communication opening 182.

A recess 117 may be formed in a bottom inner surface 171 of the ink chamber 170. The recess 117 may be formed by depressing the bottom wall 118 partly into the recessed shape. The communication hole 182 may be positioned in a recessed space 119 defined by the recess 117. With this configuration, ink may be supplied to the communication chamber 175 from the main portion of the ink chamber 170 without air entering into the communication opening 182 until the ink surface in the ink chamber 170 is lowered to reach the communication opening 182. In an embodiment, the recess 117 may be formed only on the left side face 105 side of the rib 94, and may not be formed on the right side face 106 side of the rib 94.

In an embodiment, fluid communication between the communication chamber 175 and the main portion of the ink chamber 170 may be achieved only via the communication opening 182, and fluid communication between the communication chamber 175 and the ink supply chamber 120 may be achieved only via the communication opening 181. Therefore, in this embodiment, when the ink supply valve mechanism 200 opens an ink supply opening 210, ink stored in the ink chamber 170 may flow from the recess 117 via the communication opening 182 into the communication chamber 175, and flow from the communication chamber 175 via the communication opening 181 to the ink supply chamber 120, as indicated by a broken arrow 45 in FIG. 5(*a*). Then, the ink may flow from the ink supply chamber 120 via the ink supply opening 210 to the outside of the ink cartridge 10.

The ink introduction portion 150 may be formed integrally with the frame 110. The ink introduction portion 150 may comprise a cylindrical ink introduction chamber 152 and ink introduction opening 159. The ink introduction opening 159 may be formed in the rear face 101 of the frame 110 below a middle portion of the rear face 101. The ink introduction chamber 152 may extend from the ink introduction opening 159 towards the ink chamber 170. An end of the ink introduction chamber 152 opposite the ink introduction opening 159 may be defined by the outer peripheral wall 111. Ink may be introduced into the interior of the ink introduction chamber 152 via the ink introduction opening 159.

Referring to FIG. 5(*a*), a side wall defining the ink introduction chamber 152 may have a communication opening 153 formed therethrough on the left side face 105 side. The interior and the exterior of the ink introduction chamber 152 are in fluid communication via the communication opening 153.

The partitioning wall 156 may extend from the side wall of the ink introduction chamber 152 towards the left side face 105. The partitioning wall 156 may partition the communication opening 153 from the ink chamber 170. The partitioning wall 156 may have a substantially U-shape to surround the communication opening 153, and may extend upward in the direction, as indicated by the arrow 52. The film 70 may be welded to an outer end of the partitioning wall 156 on the left side face 105 side. A further liquid path 158 may be defined by the partitioning wall 156 and the film 70.

The outer peripheral wall 111 may comprise an inclined wall 164 above the ink introduction chamber 152. The inclined wall 164 may be inclined downward from the rear face 101. The inclined wall 164 may have an opening 161 formed therethrough in the vertical direction, as indicated by the arrow 52. The partitioning wall 156 may extend to the inclined wall 164, and an end of the partitioning wall 156 may be connected to the inclined wall 164 at a surrounding area of the opening 161, such that the further liquid path 158 extends through the inclined wall 164.

A partitioning wall 157 may extend from the inclined wall 164. The partitioning wall 157 may comprise a first wall 157*a* extending from the inclined wall 164 upward in the direction, as indicated by the arrow 52, and having a L shape when seen from the top. The partitioning wall 157 also may comprise a second wall 157*b* connected to the upper end of the first wall 157*a* and extending in parallel with the inclined wall 164 towards the rear end 101. The partitioning wall 157 may partition the opening 161 from the ink chamber 170. The film 70 may be welded to an outer end of the partitioning wall 157, and an outer end of the inclined wall 164 on the left side face 105 side. A still further liquid path 166 may be defined by the partitioning wall 157, the inclined wall 164, and the film 70. The second wall 157*b* may have a communication opening 154 formed therethrough at an end of the second wall 157*b* on the rear face 101 side. The ink chamber 170 and the still further liquid path 166 may be in fluid communication via the communication opening 154.

Referring to FIG. 5(*b*), the particular liquid path 270 may extend on the right side face 106 side from the ink introduction chamber 152 to the ink supply chamber 120. The particular liquid path 270 may be positioned separately from the ink chamber 170. The outer peripheral wall 111 may have an opening 275 formed therethrough at a position defining the end of the ink introduction chamber 152 opposite the ink introduction opening 159. The particular liquid path 270 may extend downward from the opening 275 towards the bottom face 104 side, and then extend substantially in parallel with the bottom face 104 towards the front face 102. An end of the particular liquid path 270 may be connected to the opening 272. The particular liquid path 270 may be in fluid communication with the ink supply chamber 120 via the opening 272. The particular liquid path 270 may extend from the ink introduction portion 150 to the ink supply chamber 120, positioned externally from the ink chamber 170, and the ink introduction portion 150 and the ink supply chamber 120 may be in fluid communication via the particular liquid path 270. The lower portion of the ink chamber 170 may separate the ink introduction portion 150 from the communication opening 181.

The bottom wall 118 of the outer peripheral wall 11 may have a groove 277 formed therein adjacent to and along the bottom inner surface 171 of the ink chamber 170. The groove 277 may be formed in an outer end of the bottom wall 118 on the right side face 106 side. The film 70 may be connected to, e.g., welded to, the bottom wall 118 to cover the groove 277, and the particular liquid path 270 may be defined by the groove 277, the film 70, and the bottom wall 118.

When ink is introduced via the ink introduction opening 159, the ink may flow into a first path extending from the ink introduction chamber 152 through the communication opening 153, the further liquid path 158, the still further liquid path 166, and the communication opening 154 to the ink chamber 170, as indicated by an arrow 49 in FIG. 5(*a*), and the ink also may flow into a second path extending from the ink introduction chamber 152 through the opening 275, the particular liquid path 270, and the opening 272 to the ink supply chamber 120, as indicated by an arrow 47 in FIG. 5(*b*). When the ink enters the ink supply chamber 120, air in the ink supply chamber 120 may flow into a third path extending from the ink supply chamber 120 through the opening 181, the communication chamber 175, and the opening 182 to the ink chamber 170, as indicated by an arrow 48 in FIGS. 5(*a*) and 5(*b*).

Figure 6:
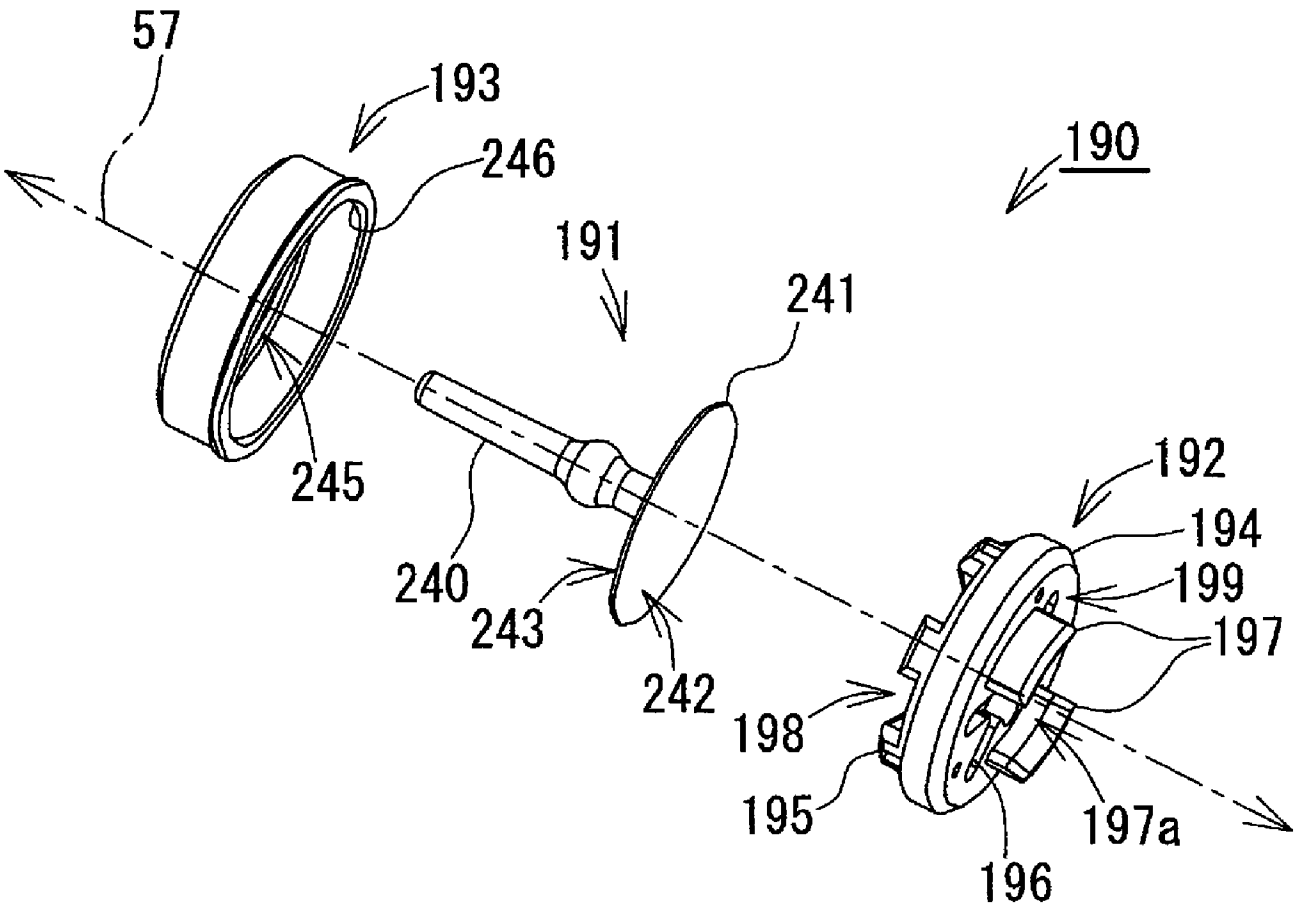
FIG. 6 is an exploded, perspective view of a check valve to be disposed in the ink cartridge of FIGS. 1(*a*) and 1(*b*).

Referring to FIG. 6, the check valve 190 may be configured to allow air to flow through the communication opening 181 from the communication chamber 175 to the ink supply chamber 120 and from the ink supply chamber 120 to the communication chamber 175 when the check valve 190 is in air, and the check valve 190 also may be configured to allow ink to flow through the communication opening 181 from the communication chamber 175 to the ink supply chamber 120, but to prevent ink from flowing through the communication opening 181 from the ink supply chamber 120 to the communication chamber 175 when the check valve 190 is in liquid.

The check valve 190 may comprise a valve body 191, a valve seat 192 configured to support the valve body 191, and a cover 193 covering the valve body 191. Each of the valve body 191, the valve seat 192, and the cover 193 may comprise at least one resin such as polypropylene, silicon rubber or the like.

The valve body may comprise a disc 241 and a shaft 240 extending from the center of the disc 241 in a direction substantially perpendicular to the disc 241. The cover 193 may be configured to be fitted into the valve storage section 126 (see FIG. 4). The cover 193 may have a cylindrical shape having a circular bottom and a peripheral wall 246 extending from the edge of the bottom. The bottom of the cover 193 may have an opening 245 formed therethrough. The shaft 240 of the valve body 191 may be inserted into the opening 245 such that the shaft portion 240 is movable with respect to the opening 245 and fluid passes through the opening 245. An inner diameter of the peripheral wall 246 of the cover 193 may greater than the outer diameter of the disc 241 of the valve body 191, and the disc 241 may be stored within the cover 193. The cover 193 and the valve seat 192 may enclose the disc 241.

The disc 241 may be a thin round resilient member. When the disc 241 resiliently contacts the bottom of the cover 193 at the surrounding area of the opening 245, the opening 245 may be closed by the disc 241. Consequently, fluid communication through the opening 245 may be blocked. When the disc 241 separates from the bottom of the cover 193, the opening 245 may be opened. Consequently, fluid communication through the opening 245 may be allowed.

The valve seat 192 may comprise a valve seat base 194 and a valve body receiving portion 195. The valve seat base 194 may have a round, disc shape. The valve seat base 194 may comprise a bottom surface 199 configured to contact the ink supply valve mechanism 200. The valve seat 192 also may comprise two ribs 197 extending from the bottom surface 199. A top portion 332 (see FIG. 7) of a second spring 206*b* may be stored in a space 197*a* surrounded by the ribs 197. The outer peripheral surface of the top portion 332 may contact the inner surfaces of the ribs 197, and consequently, the movement of the second spring 206*b* in a direction orthogonal to a direction of the movement of the ink supply valve mechanism 200 may be restricted. The valve seat base 194 may have a plurality of openings 196 formed therethrough from the bottom surface 199 to the surface opposite the bottom surface 199.

The valve body receiving portion 195 may comprise a plurality of ribs extending from the surface of the valve seat base 194 opposite from the bottom surface 199. The plurality of ribs of the valve body receiving portion 195 may be configured to contact the disc 241. A plurality of grooves 198 may be formed between adjacent ribs of the valve body receiving portion 195. The openings 196 may be connected to the grooves 198. When the disc 241 contacts the ribs of the valve receiving portion 195, the openings 196 may not be closed.

With this configuration, when ink attempts to flow from the ink supply chamber 120 to the communication chamber 175, a first surface 242 of the disc 241 may be pressed by the ink which has passed through the openings 196, such that the disc 241 moves toward the cover 193 and contacts the bottom of the cover 193, which prevents the fluid communication through the opening 245. Consequently, ink is prevented from flowing into the communication chamber 175. When ink attempts to flow from the communication chamber 175 to the ink supply chamber 120, a second surface 243 of the disc 241 may be pressed by the ink, such that the disc 243 may separate from the bottom of the cover 193. Consequently, the opening 245 may be opened, and flow of ink from the communication chamber 175 to the ink supply chamber 120 may be allowed.

In contrast, when air attempts to flow from the ink supply chamber 120 to the communication chamber 175, the air which has passed through the openings 196 towards the cover 193 may press the first surface 242 of the disc 241 towards the cover 193. Nevertheless, because air is lighter than ink and the viscosity of air is less than the viscosity of ink, the pressing force may be relatively small and may be less than the sliding resistance between the valve body 191 and the cover 193. Therefore, the disc 241 may not move toward the cover 193.

The air may flow over the disc 241 from the first surface 242 side to the second surface 241 side and flow into the opening 245.

Figure 7:
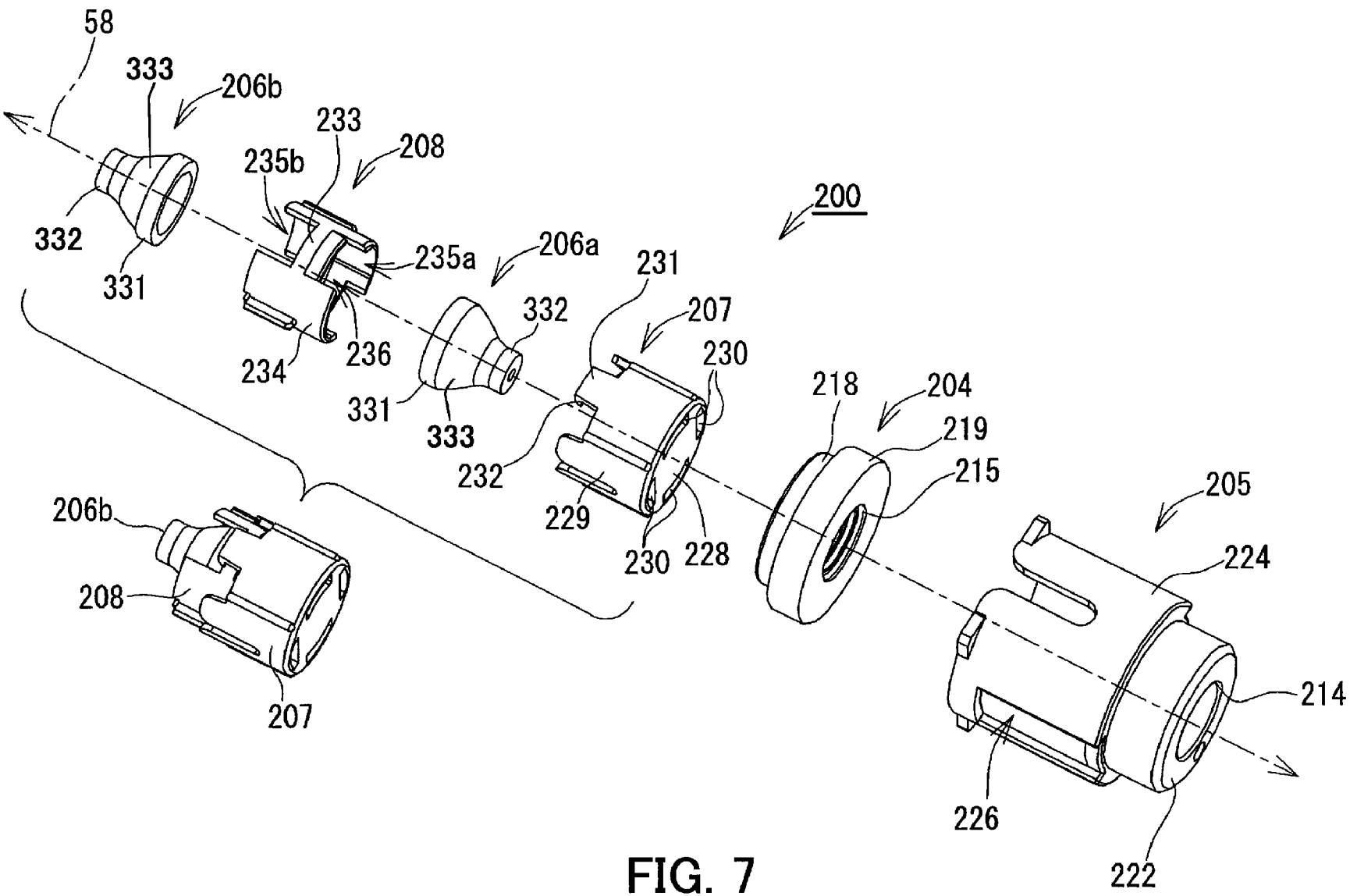
FIG. 7 is an exploded, perspective view of an ink supply valve mechanism to be disposed in the ink cartridge of FIGS. 1(*a*) and 1(*b*).

Referring to FIG. 7, the ink supply valve mechanism 200 may comprise a cap 205, a sealing member 204, a valve body 207, a first spring 206*a*, a slider 208, and a second spring 206*b* positioned in this order. The cap 205, the sealing member 204, the valve body 207, the first spring 206*a*, the slider 208, and the second spring 206*b* may comprise at least one resin such as polyacetal, silicon rubber, or the like.

The valve body 207, the first spring 206*a*, the slider 208, and the second spring 206*b* may be stored in the ink supply chamber 120. The cap 205 may be mounted to the surrounding area of the circular opening 122 sandwiching the sealing member 204 therebetween.

The cap 205 may have an opening 214 formed therethrough, and the sealing member 204 may have an opening 215 formed therethrough. When the cover 205 is mounted to the surrounding area of the opening 122, the ink supply opening 210 may be defined by the openings 214 and 215. A pipe 65 (see FIG. 8) of the printer may be configured to be inserted through the ink supply opening 210 into the ink supply chamber 120. The ink supply opening 210 may be aligned with the axial center line 176 of the ink supply chamber 120. The center line 176 may be aligned with an axial direction 58 of the ink supply valve mechanism 200.

The pipe 65 may comprise at least one resin and may be connected to a recording head (not shown) of the printer via a flexible tube (not shown). The sealing member 204 may comprise a rubber. The sealing member 204 may have an annular shape corresponding to the shape of the ink supply chamber 120 and the shape of the circular opening 122. The sealing member 204 may comprise a first cylindrical portion 218 fitted in the ink supply chamber 120 and a second cylindrical portion 219 contacting the surrounding area of the opening 122. The opening 215 may be formed through the centers of the first cylindrical portion 218 and the second cylindrical portion 219. The pipe 65 may be configured to be inserted into the opening 215. The diameter of the opening 215 may be slightly less than the outer diameter of the pipe 65. When the pipe 65 is inserted into the opening 215, the outer peripheral surface of the pipe 65 may press against a portion of the sealing member 204 defining the opening 215. Consequently, ink may be prevented from leaking between the pipe 65 and the sealing member 204.

The cap 205 may be configured to guide the ink pipe 65 into the ink supply chamber 120. The cap 205 may comprise a disk-shaped wall 222, and a cylindrical wall 224 extending from the outer edge of the wall 222. The wall 222 may have the opening 214 formed therethrough. The wall 224 may have a plurality, e.g., two, of the elongated openings 226 formed therethrough. The cylindrical wall 124 of the ink supply chamber 120 may have claws extending outwardly, and the claws may be inserted into the elongated openings 226, which positions the cap 205 with respect to the cylindrical wall 124.

The valve body 207 may comprise a disk-shaped wall 228 and a cylindrical wall 229 extending from the outer edge of the wall 228. The wall 228 may have a plurality e.g., four, of the openings 230 aligned in the circumferential direction of the wall 228. The openings 230 may be positioned adjacent to the outer edge of the wall 228. When the wall 228 contacts the sealing member 204, a center portion of the wall 228 may close the opening 215.

The valve body 207 may have an inner space defined by the wall 228 and the wall 229. The first spring 206*a* may be stored in the inner space of the valve body 207. The wall 228 may contact and support the first spring 206*a*. The valve body 207 may comprise a plurality, e.g., two, of strips 231 extending from the end of the wall 229 in the axial direction 58, and hooks 232 provided at ends of the strips 231. The hooks 232 may be configured to engage a bottom wall 233 of the slider 208, such that the valve body 207 and the slider 208 are coupled.

The valve body 207 may be configured to slide in ink supply chamber 120 in the depth direction, as indicated by the arrow 53, with a gap between the wall 229 and the inner surface of the ink supply chamber 120.

Each of the first spring 206*a* and the second spring 206*b* may have a bowl shape or a hollow, conical shape, and may comprise an annular bottom portion 331, an annular top portion 332, and a body portion 333 connected to the bottom portion 331 at one end and connected to the top portion 332 at the other end. The body portion 333 may be configured to be bent and deformed when a load is applied to the first spring 206*a* or the second spring 206*b* in the axial direction 58. Each of the springs 206*a* and 206*b* may comprise silicon rubber.

The slider 208 may be configured to support the first spring 206*a* and the second spring 206*b*, and may comprise the disk-shaped bottom wall 233 and a cylindrical wall 234 extending from the outer edge of the bottom wall 233 in the opposite two directions, respectively. The bottom wall 233 and the wall 234 may define two inner spaces 235*a* and 235*b* positioned adjacent to each other in the axial direction 58. The inner space 235*a* may receive the first spring 206*a*, and the inner space 235*b* may receive the second spring 206*b*.

The outer diameter of the wall 234 of the slider 208 may be less than the inner diameter of the wall 229 of the valve body 207, such that the slider 208 is stored in the inner space of the valve body 207. The slider 208 may be slidably supported in the inner space of the valve body 207 in the axial direction 58.

The bottom wall 233 may have an opening 236 formed through the center portion thereof. The slider 208 may have a plurality of cutouts formed therethrough extending from the end of the wall 234 to the bottom plate 233 in the axial direction 58. The strips 231 of the valve body 207 may be configured to be inserted into the cutouts of the wall 234, and the hooks 232 may be configured to be engaged with the bottom plate 233, such that the slider 208 and the valve body 207 are coupled, storing the first spring 206*a* therebetween. When the valve body 207 and the slider 208 are pressed toward each other in the axial direction 58, the first spring 206*a* may be compressed in the axial direction 58, and then when the pressure is released, the first spring 206*a* may expand, such that the valve body 207 and the slider 208 return to their original positions.

Figure 8A:
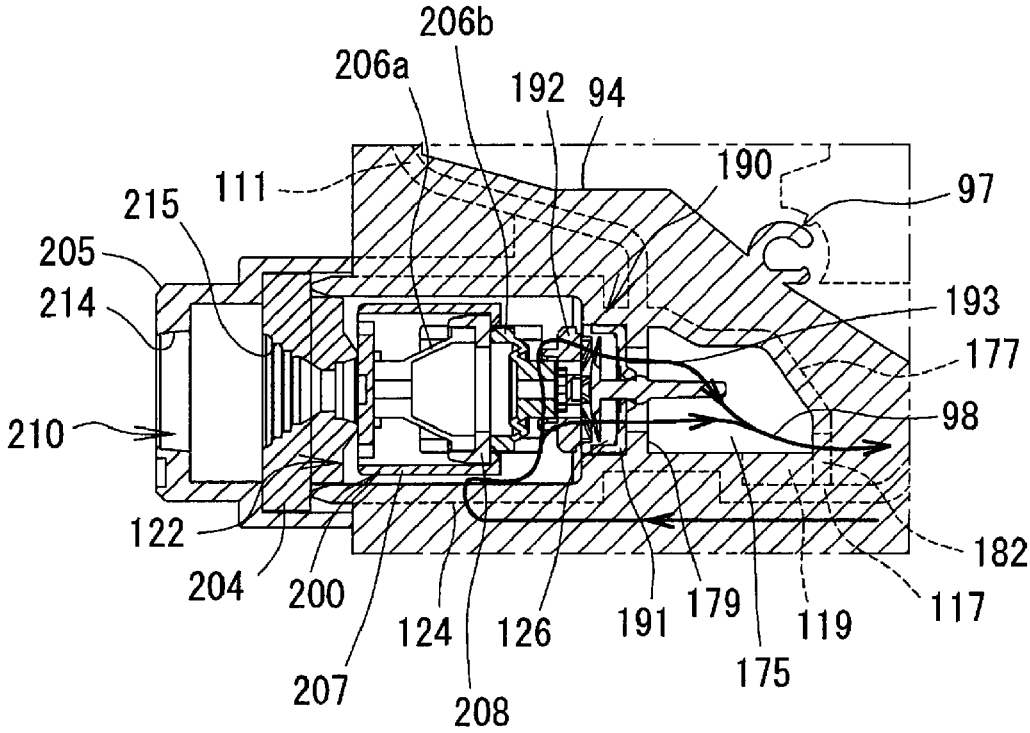
FIGS. 8(*a*) and 8(*b*) are cross-sectional views of the ink supply valve mechanism of FIG. 7 when the ink cartridge is filled with ink and when ink is supplied from the interior of the ink cartridge to the exterior of the ink cartridge, respectively.
Figure 8B:
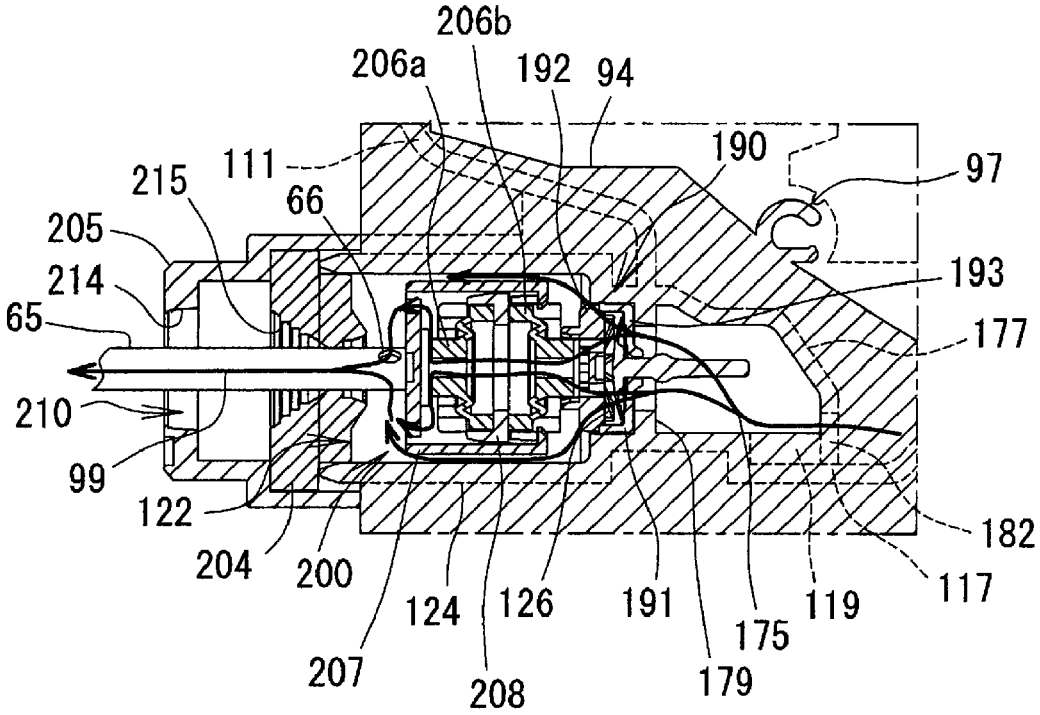

Referring to FIG. 8(*a*), when ink is introduced via the ink introduction opening 159 in a state in which the ink supply opening 210 is closed, i.e., the circular opening 122 is closed, by the ink supply valve mechanism 200, a fluid path, e.g., a path of ink or air, or both, may be formed as indicated by the arrow 98. The fluid path may pass through the particular liquid path 270, the opening 272, the openings 196 of the valve seat 192, the opening 245 of the cover 193, the communication chamber 175 and the communication opening 182.

Referring to FIG. 8(*b*), when the pipe 65 is inserted into the ink supply chamber 120 from the ink supply opening 210, a distal end of the pipe 65 may press the valve body 207 against the urging force of the first spring 206*a* and the second spring 206*b*. Consequently, the valve body 207 may separate from the sealing member 204, and the ink supply opening 210 may be opened, i.e., the circular opening 122 may be opened. The pipe 65 may have an opening 66 formed therethrough adjacent to the distal end of the pipe 65. Therefore, when the valve body 207 separates from the sealing member 204, the ink supply chamber 120 may be in fluid communication with the interior of the pipe 65 through the opening 66.

When the valve body 207 separates from the sealing member 204, a fluid path, e.g., a path of ink or air, or both, may be formed, as indicated by the arrow 99. The fluid path 99 may pass through the opening 245 of the cover 193, the openings 196 of the valve seat 192, the interior of the first spring 206*a*, the opening 236 of the slider 208, the interior of the second spring 206*b*, the openings 230 of the valve body 207, and the opening 66 of the pipe 65. The fluid also may pass through the opening 245 of the cover 193, the openings 196 of the valve seat 192*b*, the gap between the valve body 207 and the inner surface of the ink supply chamber 120, and the opening 66 of the pipe 65.

Figures 9A, 9B, 9C:
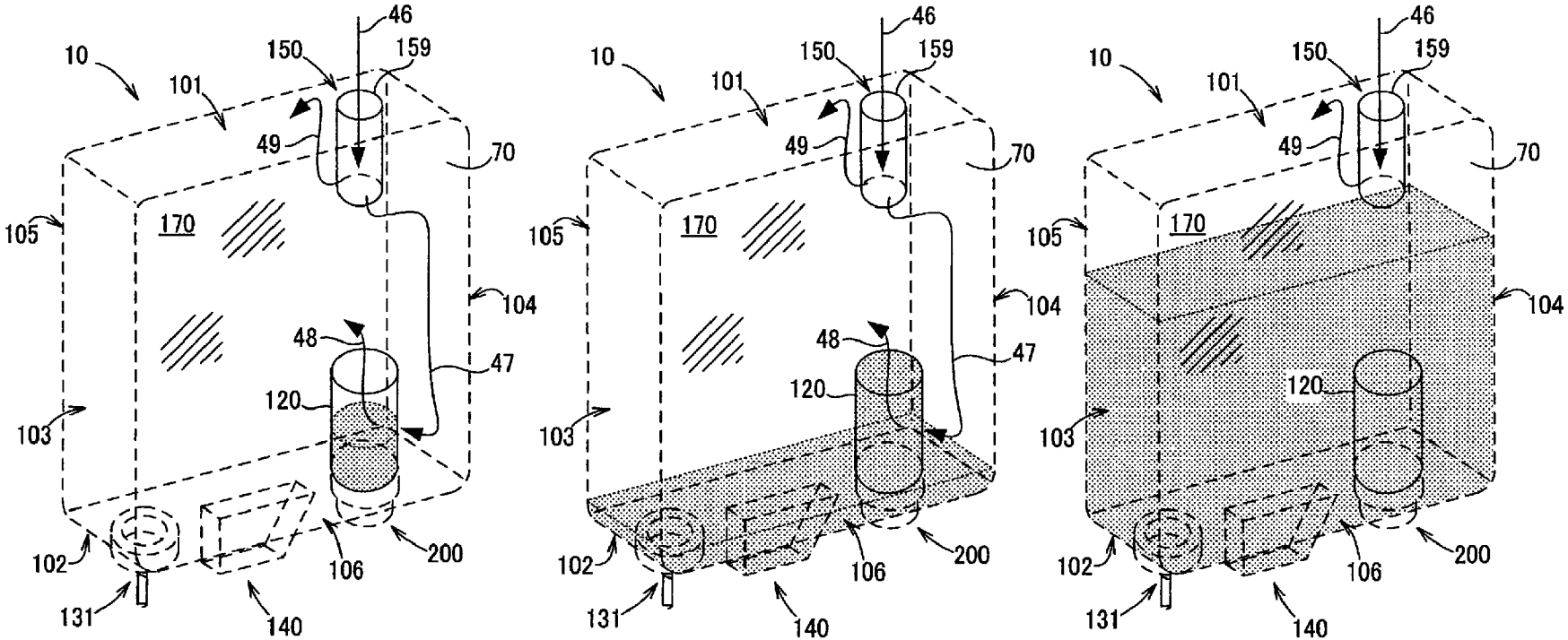
FIGS. 9(*a*)-(*c*) are schematics depicting a process of filling the ink cartridge with ink. Specifically, FIG. 9(*a*) depicts a state in which the ink supply chamber is partially filled with ink.

Referring to FIGS. 9(*a*) through 9(*c*), when the ink cartridge 10 is filled with ink, the ink cartridge 10 may be positioned in a predetermined orientation, e.g., such that the front face 102 of the ink cartridge 10 faces downward and the rear face 101 face upward, and the circular opening 122 and the communication opening 181 are aligned in a direction substantially parallel to the direction of gravitational force. The ink supply opening 210 may be closed, i.e., the circular opening 122 may be closed. Then, the air intake valve mechanism 131 may be operated to open the opening 132 to the atmosphere, such that the ink chamber 170 is in fluid communication with the atmosphere via the opening 264, the bypass 260, and the opening 132. Then, ink may be introduced via the ink introduction opening 159. Referring to FIG. 9(*a*), ink may flow into the ink supply chamber 120 through the second path as indicated by the arrow 47, i.e., through the opening 275, the particular liquid path 270, and the opening 272. When ink enters the ink supply chamber 120, air in the ink supply chamber 120 may flow into the ink chamber 170 through the third path, as indicated by the arrow 48, i.e., through, the check valve 190, the opening 181, the communication chamber 175, and the opening 182. Ink also may flow into the ink chamber 170 through the first path, as indicated by the arrow 49, i.e., through the communication opening 153, the further liquid path 158, the still further liquid path 166, and the communication opening 154.

In this embodiment, because the front face 102 faces downward, the first path as indicated by the arrow 49 extends upward. On the other hand, the second path, as indicated by the arrow 47 extends downward. Consequently, most of the ink introduced via the ink introduction opening 159 may flow into the second path, as indicated by the arrow 47.

Air in the ink supply chamber 120 may be replaced by ink, and when ink is further introduced, referring to FIG. 9(*b*), the ink supply chamber 120 may be entirely filled with ink. At this time, the check valve 190 may be operated, and thereby fluid communication between the ink supply chamber 120 and the communication chamber 175 via the check valve 190 may be prevented. Therefore, after the ink supply chamber 120 is entirely filled with ink, all the ink introduced via the ink introduction opening 159 may flow into the ink chamber 170 via the first path, as indicated by the arrow 49. When ink enters the ink chamber 170, air in the ink chamber 170 may flow out of ink chamber 170 to the exterior of the ink cartridge 10 via opening 264, the bypass 260, and the opening 132. Then, referring to FIG. 9(*c*), ink may be continuously introduced to until the amount of air in the ink chamber 170 is reduced to a predetermined amount. After that, the air intake valve mechanism 131 may be operated to close the opening 132 and a rubber plug may be press fitted into the ink introduction chamber 152 of the ink introduction portion 150. A predetermined amount of air may remain in the ink chamber 170.

As described above, ink may flow into the ink supply chamber 120 directly through the second path as indicated by the arrow 47, and hence air in the ink supply chamber 120 may be transferred to the ink chamber 170 almost completely. Therefore, almost no air may remain in the ink supply chamber 120.

When the ink supply chamber 120 is entirely filled with ink, the check valve 190 may be operated, and ink may flow into the ink chamber 170 only via the first path indicated by the arrow 49. Because the first path is relatively short and has a relatively smaller flow resistance, ink may be quickly introduced into the ink chamber 170.

In another embodiment, the check valve 190 may be replaced by a valve member configured to regulate flow of ink through the communication opening 181 from the ink supply chamber 120 to the communication chamber 175. For example, the valve member may be configured such that flow rate of ink through the communication opening 181 from the ink supply chamber 120 to the communication chamber 175 is ten times less than flow rate of ink through the communication opening 180 from the communication chamber 175 to the ink supply chamber 120. In such an embodiment, when the ink cartridge 10 is filled with ink, the ink cartridge 10 may be positioned in a predetermined orientation, such that the front face 102 of the ink cartridge 10 faces downward and the rear face 101 faces upward, and ink introduced via the ink introduction opening 159 may flow into the ink chamber 170 via the second and third paths, as indicated by the arrows 47 and 48, as well as the first path as indicted by the arrow 49 after the ink supply chamber 120 is entirely filled with ink.

In another embodiment, no valve element may be positioned at the communication opening 181. In such an embodiment, when the ink cartridge 10 is filled with ink, the ink cartridge 10 may be positioned such that the front face 102 of the ink cartridge 10 faces downward and the rear face 101 faces upward, ink introduced via the ink introduction opening 159 may flow into the ink chamber 170 via the second and third paths, as indicated by the arrows 47 and 48, as well as the first path as indicted by the arrow 49 after the ink supply chamber 120 is entirely filled with ink.

In another embodiment, the present invention may be applied also to liquid containers configured to store liquid other than ink, e.g., liquid fuel.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. A liquid container comprising:

a liquid chamber configured to store liquid therein, wherein the liquid chamber is defined by at least one first wall;

a liquid supply chamber defined by at least one second wall having a first opening, a second opening, and a third opening formed therethrough, wherein the liquid chamber is further configured to be in fluid communication with the liquid supply chamber via the first opening, and the liquid supply chamber is configured to be in fluid communication with an exterior of the liquid container via the third opening;

a liquid introduction portion; and a particular liquid path extending from the liquid introduction portion to the second opening, wherein the second opening is positioned between the first opening and the third opening, the liquid introduction portion is configured to introduce fluid from the exterior of the fluid container to the liquid supply chamber via the particular liquid path, and the particular liquid path is positioned externally from the liquid chamber.

2. The liquid container of claim 1 further comprising a valve member configured to regulate liquid flow between the liquid chamber and the liquid supply chamber via the first opening.

3. The liquid container of claim 2, wherein the valve member comprises a check valve configured to prevent liquid from flowing from the liquid supply chamber to the liquid chamber at least after the liquid supply chamber is filled with liquid via the particular liquid path.

4. The liquid container of claim 3 further comprising a further liquid path extending from the liquid introduction portion to the liquid chamber.

5. The liquid container of claim 1, wherein the at least one first wall at least partially defines the particular liquid path.

6. The liquid container of claim 1, further comprising:

a frame comprising the at least one first wall, wherein the frame has a groove formed therein; and at least one film connected to the at least one first wall, wherein the at least one first wall and the at least one film define the liquid chamber, and the particular liquid path is at least partially defined by the at least one film and the groove.

7. The liquid container of claim 6, wherein the particular liquid path is defined by the at least one film, the groove, and the at least one first wall.

8. The liquid container of claim 1, further comprising a valve mechanism, configured to selectively open and close the third opening, wherein at least a portion of the valve mechanism is positioned within the liquid supply chamber, and wherein when the valve mechanism is in an open position, liquid flows from the liquid supply chamber to the exterior of the liquid container via the third opening, and when the valve mechanism is in a closed position, the valve mechanism prevents liquid from flowing from the liquid supply chamber to the exterior of the liquid container via the third opening.

9. The liquid container of claim 1, wherein at least a portion of the liquid chamber separates the liquid introduction portion from the first opening.

10. The liquid container of claim 1, wherein the liquid introduction portion is defined by at least one third wall having a fourth opening formed therethrough, and the particular liquid path extends from the fourth opening to the second opening.

11. A liquid container comprising:

a liquid chamber configured to store liquid therein, wherein the liquid chamber is defined by at least one first wall;

a liquid supply chamber defined by at least one second wall having a first opening and a second opening formed therethrough;

a liquid introduction portion;

a valve member positioned at the first opening and configured to regulate liquid flow between the liquid chamber and the liquid supply chamber via the first opening; and a particular liquid path extending from the liquid introduction portion to the second opening, wherein the liquid introduction portion is configured to introduce fluid from an exterior of the fluid container to the liquid supply chamber via the particular liquid path, and the particular liquid path is positioned externally from the liquid chamber.

12. The liquid container of claim 11, wherein the valve member comprises a check valve configured to prevent liquid from flowing from the liquid supply chamber to the liquid chamber at least after the liquid supply chamber is filled with liquid via the particular liquid path.

13. The liquid container of claim 12 further comprising a further liquid path extending from the liquid introduction portion to the liquid chamber.

* * * * *